United States Patent [19]

Lynch

[11] Patent Number: 4,809,792

[45] Date of Patent: Mar. 7, 1989

[54] SUPPORT SYSTEM FOR A TOP DRIVEN DRILLING UNIT

[75] Inventor: James E. Lynch, Dallas, Tex.

[73] Assignee: National-Oilwell, Houston, Tex.

[21] Appl. No.: 163,584

[22] Filed: Mar. 3, 1988

[51] Int. Cl.[4] ..... E21B 19/06

[52] U.S. Cl. ..... 175/113; 173/44; 173/164

[58] Field of Search ..... 175/113, 162, 203; 166/77.5, 85; 173/42, 43, 44, 164

[56] References Cited

U.S. PATENT DOCUMENTS 4,587,503 5/1986 Johnson et al. ..... 175/113

*Primary Examiner*—William P. Neuder

*Attorney, Agent, or Firm*—R. J. Bunyard; R. H. Johnson; L. A. Fillnow

[57] ABSTRACT

A top driven driling unit including a motor drive assembly for rotating a drill string and a handling system for supporting the drill string. The motor drive assembly includes a drill motor, a swivel bearing for supporting the load of the drill string during drilling and a sub assembly for connecting the drill motor to the drill string. The handling system includes a housing for supporting the swivel bearing, a handling ring, a stem for supporting the load of the drill string during tripping, an elevator, elevator links for supporting the elevator from the handling ring, a traveling block, and support links for supporting the housing from the traveling block. The structural relationship between the handling ring, the stem, and the housing provides an alternative load path for elevator loads during tripping or when running well casing liner that bypasses the swivel bearing.

20 Claims, 7 Drawing Sheets

SUPPORT SYSTEM FOR A TOP DRIVEN DRILLING UNIT

BACKGROUND OF THE INVENTION

This invention relates to a support system in a top driven drilling unit. More particularly, the invention relates to a handling system for supporting a drill string during tripping sequence when drilling a well and supporting a casing string when lining a well.

Conventional rotary drilling requires the use of a rotary table, a motor mounted on or below the rig floor for rotating the table, and a kelly for rotationally connecting the table to the drill string. In recent years, these drilling units are being replaced by or retrofitted with top driven drilling units which rotate the drill string using a motor suspended from a traveling block within a standard derrick or mast, hereafter referred to as a derrick.

Hereafter, a top driven unit will be referred to as a power swivel. The drilling motor is connected to the drill string by a cylindrical stem or sub assembly extending downwardly within the derrick from the drill motor. Drilling is accomplished by the powered rotation of the drill string. A cutting tool or bit is placed at the bottom end of the drill string which, through the rotational energy supplied by the drill motor, cuts through the earth's formations and deepens a well. As the well is drilled, the bit becomes worn and periodically must be replaced. When replacement of the bit becomes necessary, a portion of the drill string corresponding in length to one or more sections of drill pipe must be removed from the well and pulled above the drill rig floor. This portion of the drill string is removed and stored on the rig. The drill string is again pulled from the well exposing the next section above the floor and is similarly removed. This sequence, usually referred to as tripping out, is continued until the entire drill string is removed from the well. The bit on the bottom pipe section is replaced and the drill string is reassembled; i.e. tripping in, by connecting all the pipe sections previously removed. The drill string may be 10,000 feet (3050 m) or longer weighing 300,000 pounds (136,000 kg) or more. For a typical top driven drilling unit, the load of the drill string is supported by a swivel bearing during the tripping operations. The stress, impact and increased number of loaded cycles upon the bearing when supporting the drill string during tripping causes additional wear and may result in premature failure of the swivel bearing. Another concern is catastrophic failure of the swivel bearing housing caused by cyclical fatigue. Depending on the number of pipe lengths removed from the drill string during each "trip", the swivel bearing would be loaded and unloaded over 100 times when removing a 10,000 foot (3050 m) drill string from the well.

Because of many factors including unstable strata formations through which a well is drilled, the well normally will be lined with well casing. Lowering of the casing into the well is delayed for as long as possible while drilling a well. This casing may weigh more than 1,000,000 pounds (454,000 kg). Accordingly, the power swivel is normally removed from the derrick and replaced with a conventional hook assembly when casing is ready for running into the well.

Although they have a large operating cost advantage over conventional rotary table drilling units, top driven drilling units have structural deficiencies not previously anticipated. Excessive wear to the swivel bearing can result in premature failure resulting in costly downtime to remove and repair the power swivel. There is also concern for human safety because of potential structural failure of the swivel body resulting from cyclical fatigue during tripping. A further concern is the inability of power swivels to handle running of casing liners into a well with a proper safety factor. I have designed a power swivel having an improved structural system which overcomes the above stated problems and concerns. My structural system isolates the swivel bearing from elevator loads during tripping or when running casing liner. The load passes along a load path which bypasses the swivel bearing. The only time the swivel bearing of my power swivel is loaded occurs when the drill string is connected to the sub assembly during drilling or back-reaming. Accordingly, it is anticipated downtime and operation costs using the improved structural system of my power swivel will be reduced.

BRIEF SUMMARY OF THE INVENTION

My invention relates to a power swivel for use in a derrick including a motor drive assembly for rotating a drill string and a handling system for supporting the drill string. The drive assembly includes a drill motor, a swivel bearing for supporting the load of the drill string during drilling and a sub assembly for connecting the drill motor to the drill string. The handling system includes a swivel bearing housing beam for supporting the swivel bearing and means for supporting the load of the drill string during tripping or the load of a casing when lining a well.

It is a principal object of my invention to provide a handling system which isolates the swivel bearing from elevator loads during tripping and casing handling.

Another object of my invention is to provide a power swivel which can safely be used to run casing liner into a well.

A further object of my invention is to route the load of the drilling string during tripping along a structural member which is not supported by the swivel bearing.

An advantage of my invention is reduction of wear on the swivel bearing to prevent premature failure thereby minimizing downtime and cost of operation.

Another advantage of my invention is an increased margin for operator safety by minimizing the potential for structural failure.

The above and other objects, features and advantages of my invention will become apparent upon consideration of the detailed description and appended drawing.

DETAILED DESCRIPTION OF THE PREFERRED EMBODIMENT

Figure 1:
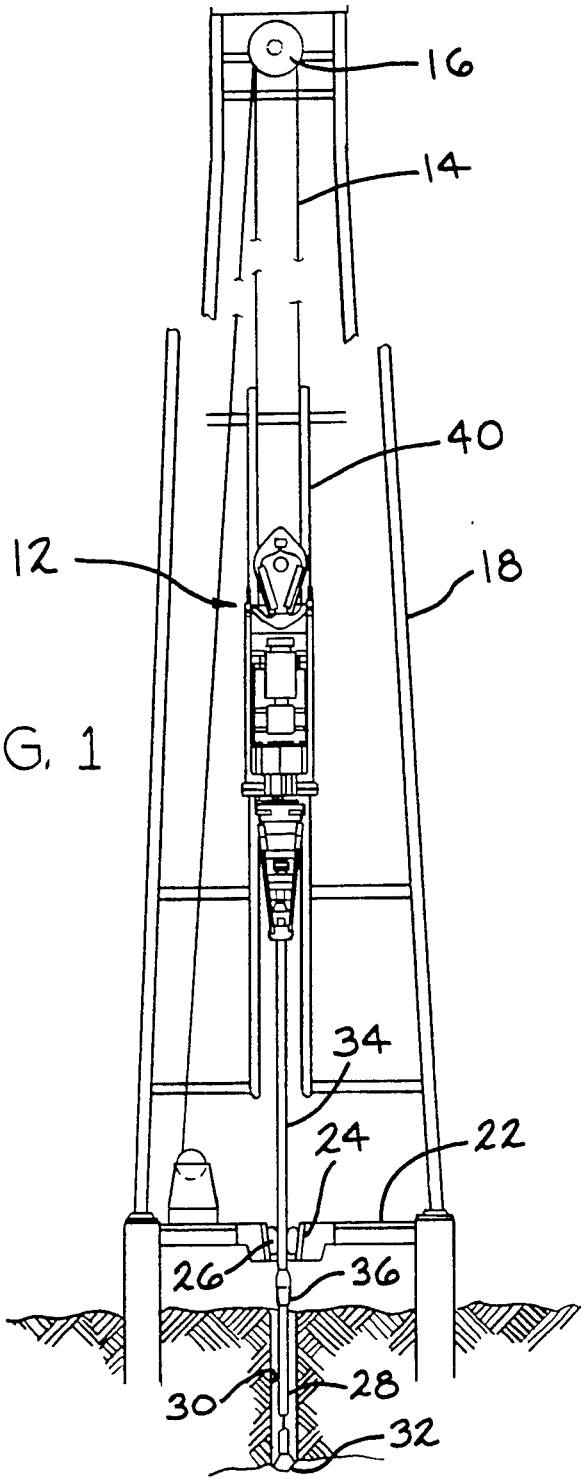
FIG. 1 is a schematic view of a top driven drilling unit incorporating my invention.

Referring to FIG. 1, reference numeral 12 denotes a top driven drilling unit, hereafter referred to as a power swivel, suspended from a crown block 16 within a derrick 18 by a rope 14 reeved over block 16 and around a drawworks 20. Derrick 18 includes a rig floor 22, a slip bowl 24 and slips 26. A drill string 28 is rotated into a well 30 by the cutting action of a drill bit 32 mounted at the bottom of drill string 28. Drill string 28 is connected to power swivel 12 through one or more sections of drill pipe 34 via a tool joint 36. When pipe 14 is added to or removed from drill string 28, drill string 28 is supported by slips 26 in bowl 24. Power swivel 12 is remotely operated from a console (not shown) on rig floor 22 for simultaneous powered rotation of drill string 28 and vertical movement along a pair of guide tracks 40.

Figure 2:
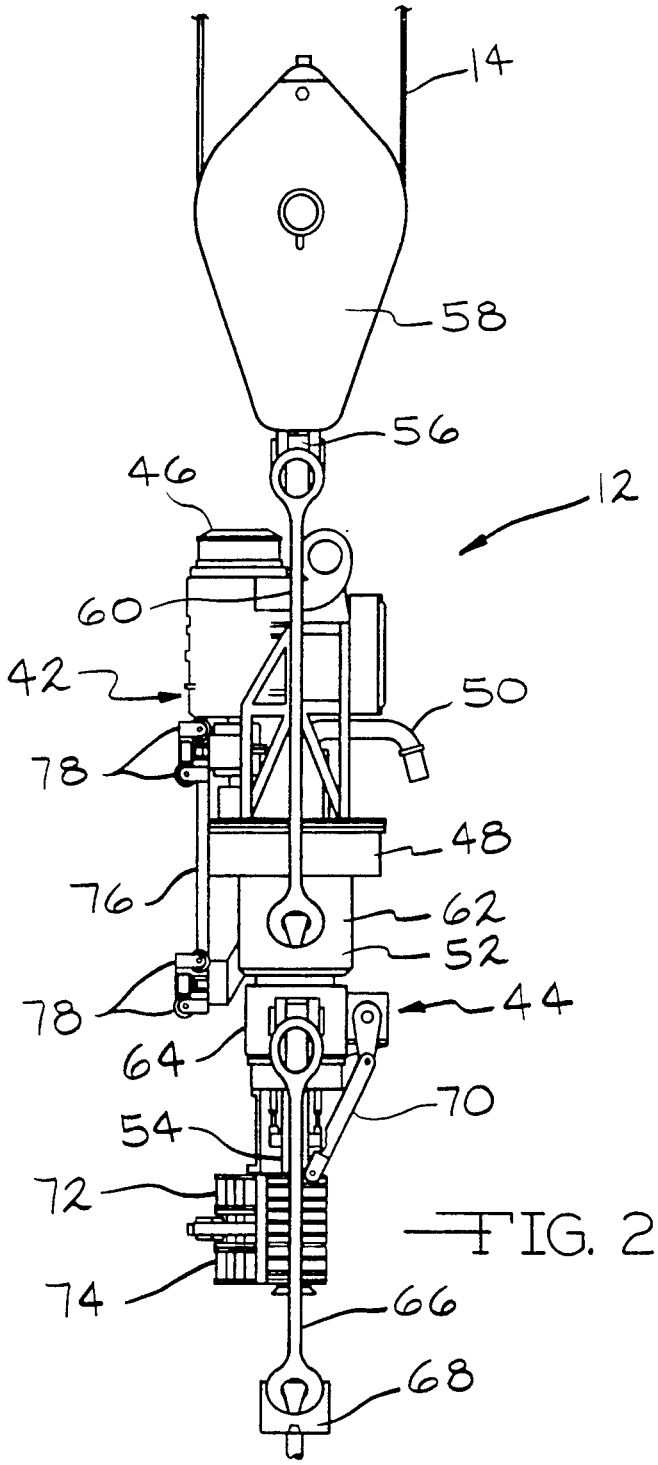
FIG. 2 is an elevation view of the motor drive assembly and the handling system of FIG. 1.

FIG. 2 shows the components of power swivel 12. Power swivel 12 includes a motor drive assembly 42 and a handling system 44. Motor drive assembly 42 includes a drill motor 46, a gear box 48, a mud gooseneck 50, a swivel bearing 52, and a sub assembly 54. Handling system 44 includes a cross beam 56 mounted at the bottom of a traveling block 58 for supporting a pair of main links 60, a swivel bearing housing beam 62, a handling ring 64, a pair of elevator links 66 supported from handling ring 64 for supporting an elevator 68, and a kick-out mechanism 70 for actuating make-break device 72 and grabs 74. Housing beam 62 supports swivel bearing 52 and has a through-bore for receiving sub assembly 54. Power swivel 12 is mounted onto a cart 76 which is supported by guide tracks 40 for vertical movement within derrick 18 via rollers 78.

Figure 3:
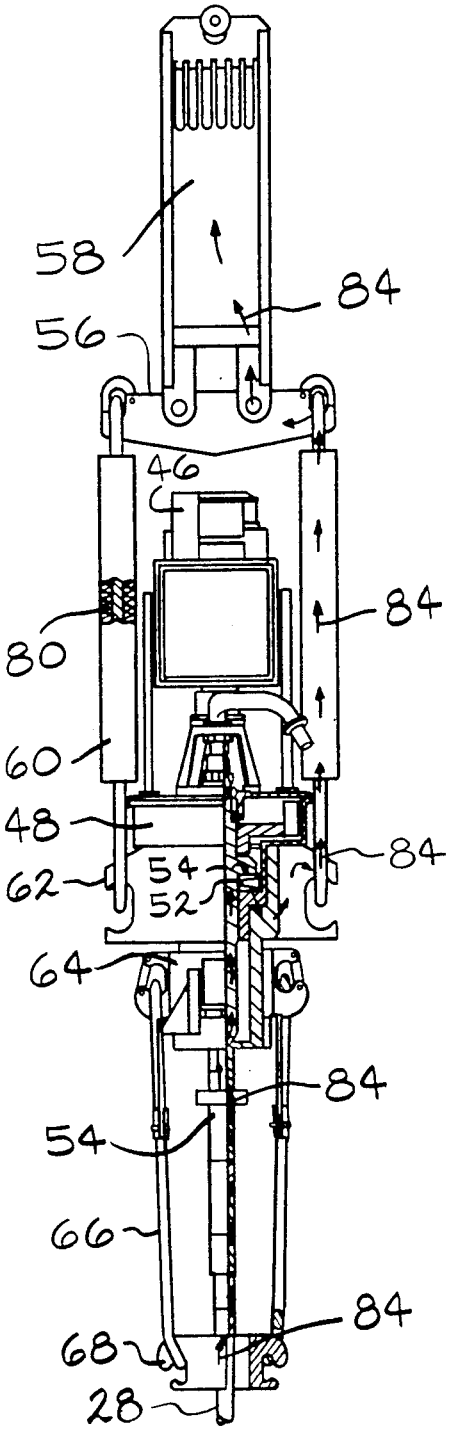
FIG. 3 is an elevation view, partially in section, of my power swivel showing the load path during drilling.
Figure 4:
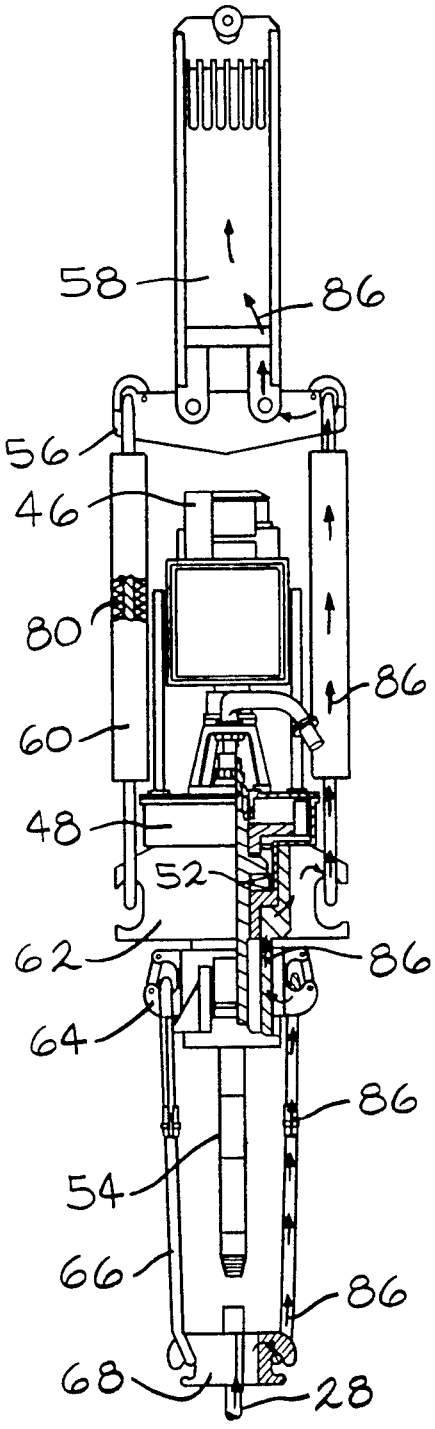
FIG. 4 is an elevation view, partially in section, of the power swivel of FIG. 3 showing the load path during tripping.

For clarity, make-break device 72 and grabs 74 have been removed from FIGS. 3 and 4. FIG. 3 shows a load path 84 (arrows) during drilling when sub assembly 54 connects drill motor 46 to drill string 28. As is well known, sub assembly 54 is the drive sleeve for drill motor 46 and includes a number of lower tubular members threaded together generally including a lower saver sub for threading into the drill string, a kellycock and a packing sub. The drilling load passes upwardly along path 84 from drill string 28, through sub assembly 54, to a point just above and through swivel bearing 52. After passing through swivel bearing 52, the load passes outwardly through housing beam 62 into main links 60, upwardly to cross beam 56 and into traveling block 58. Most power swivels include a counterbalance for reducing wear and impact between the threaded connections of the drill string and the saver sub of the sub assembly. Each link 60 is provided with a spring 80 for counterbalancing the suspended portion of the weight of power swivel 12.

FIG. 4 shows a load path 86 when drill string 28 (or a well casing liner) is supported by elevator 68 during a tripping sequence. Unlike FIG. 3 sub assembly 54 has been previously disconnected from drill string 28. Load path 86 passes through elevator 68, elevator links 66, handling ring 64, bypassing swivel bearing 52 through housing beam 62, upwardly through main links 60, cross beam 56 and into traveling block 58.

Figure 5:
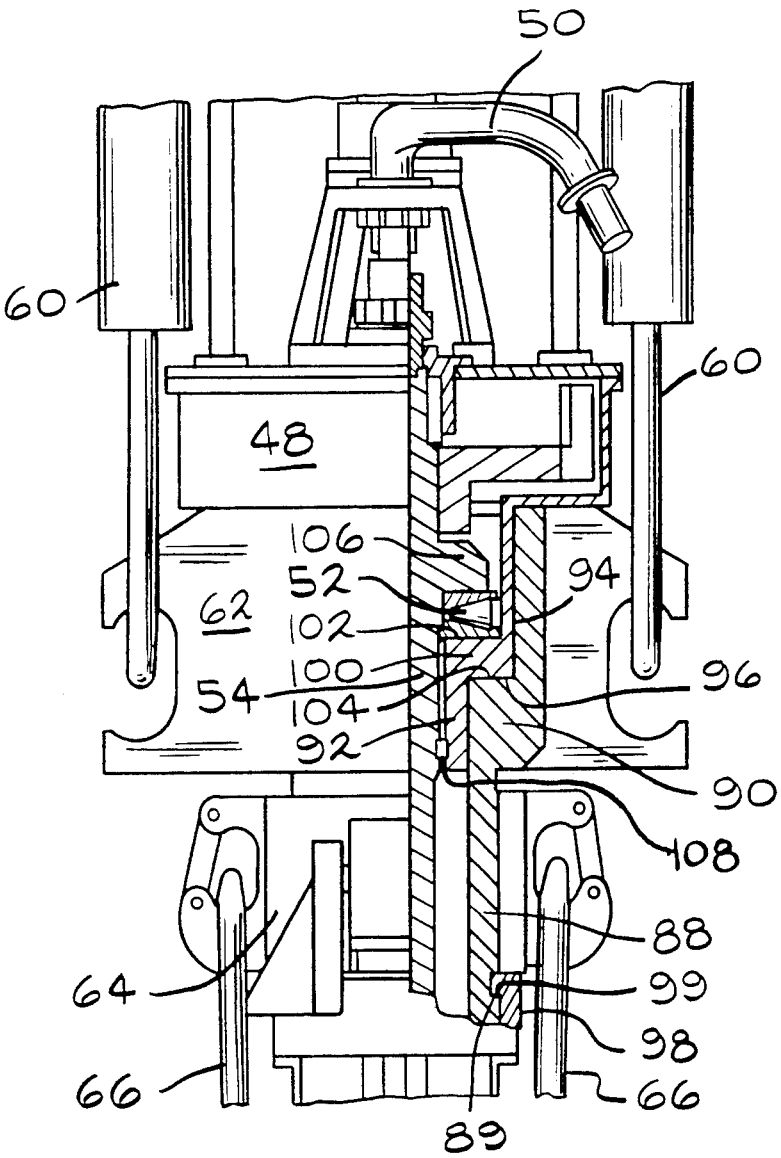
FIG. 5 is an elevation view, partially in section, showing detail of the housing beam and handling ring of the handling system shown in FIGS. 3 and 4.

FIG. 5 illustrates in detail the internal hardware of housing beam 62 and handling ring 64 making it possible for isolating swivel bearing 52 from load path 86 during a tripping operation. Housing beam 62 includes an annular housing support 90. The internal surface 94 of housing support 90 includes a shoulder 96. A bearing member 92 is held concentric with sub assembly 54 by a bearing 108 and includes a shoulder 100 having an upper surface 102 and a lower surface 104. A bearing race for swivel bearing 52 rests on upper surface 102 while lower surface 104 rests on shoulder 96 of housing support 90. When drill string 28 is connected to drill motor 46 via sub assembly 54, the load of drill string 28 passes through a shoulder 106 from the drive shaft of sub assembly 54, through swivel bearing 52 into shoulder 96 of housing support 90 via shoulder 100 of bearing member 92. When drill string 28 is suspended using elevator 68, the load of drill string 28 passes from links 66 to handling ring 64 to a stem 88. Handling ring 64 is supported by stem 88 through a shear ring 98. The lower end of stem 88 includes a shoulder 89 for supporting a shoulder 99 on shear ring 98. Load path 86 passes upwardly along stem 88 to housing support 90 into support links 60 completely bypassing swivel bearing 52.

In FIG. 5, stem 88 is an integral part of housing support 90 extending downwardly from housing beam 62 into handling ring 64. Handling ring 64 is supported by housing support 90 through stem 88 via shear ring 98. As will be demonstrated hereafter, stem 88 need not be integral with housing support 90. Stem 88 need only be supported by housing support 90 so that an alternative load path to sub assembly 54 and swivel bearing 52 be provided for transferring loads supported by elevator 68 such as drill string 28 during a tripping sequence or casing when lining well 20.

Figure 6:
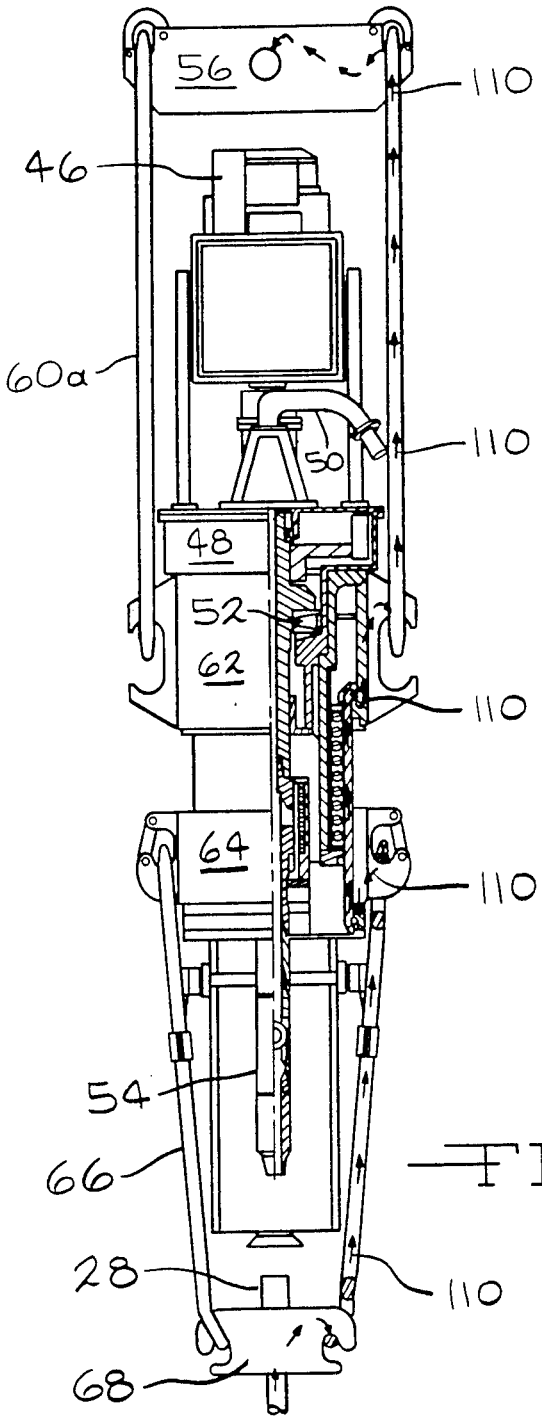
FIG. 6 is an elevation view, partially in section, of a modified power swivel of my invention showing the load path during tripping.

FIG. 6 shows a load path 110 for handling system 44 having a different embodiment for transferring a load that bypassing swivel bearing 52. As discussed above for load path 86, load path 110 of FIG. 6 completely isolates swivel bearing 52 in housing beam 62 when drill string 28 is not connected to sub assembly 54 but supported by elevator 68.

Figure 7:
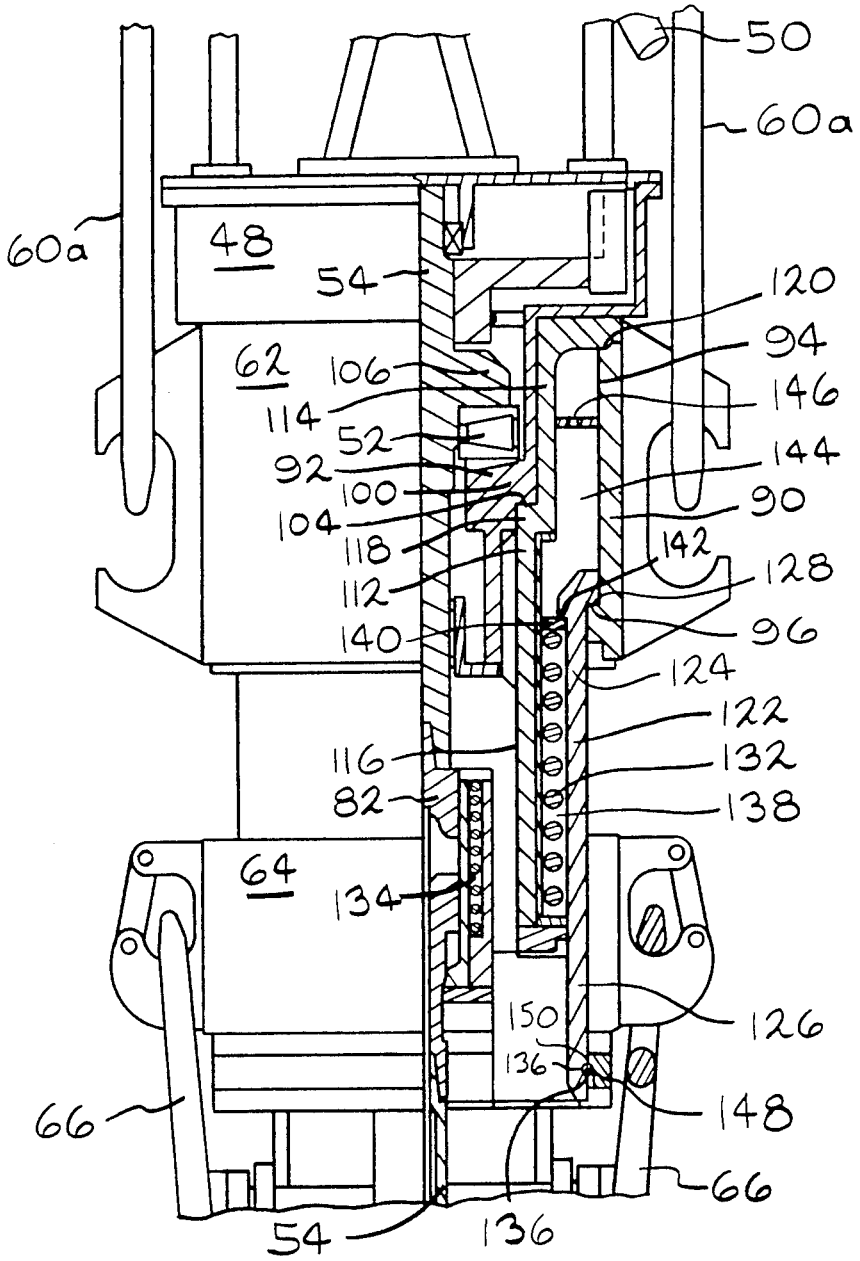
FIG. 7 is an elevation view, partially in section, showing detail of the housing beam and handling ring of the handling system shown in FIG. 6.

FIG. 7 illustrates in detail the internal hardwall of housing beam 62 and handling ring 64 in FIG. 6. In addition to housing support 90 and bearing member 92, housing beam 62 includes a bearing load supporting ring 112 having an upper end 114 and a lower end 116 extending downwardly into handling ring 64. The internal surface of ring 112 includes a shoulder 118 and the outer surface of ring 112 includes a shoulder 120. Shoulder 100 of bearing member 92 is seated on shoulder 118 of ring 112. Shoulder 120 of ring 112 is seated on the upper end of housing support 90. During drilling, loads from sub assembly 54 pass through shoulder 106, swivel bearing 52, shoulder 100, shoulder 118, shoulder 120, housing support 90 and into links 60*a*. Handling ring 64 includes an annular stem 122 having an upper end 124 and a lower end 126. The outer surface of stem 122 includes a shoulder 128 at upper end 124 and a shoulder 130 at lower end 126. Stem 122 is slidably disposed between housing support 90 and lower end 116 of ring 112. Counterbalancing springs 80 in links 60 of FIGS. 3 and 4 have been replaced by a compression sub 82 in sub assembly 54 and a spring 132 disposed between stem 122 and lower end 116 of ring 112. Compression sub 82 includes a spring 134 which allows sub assembly 54 to travel a short distance from a neutral position to reduce impact force on threaded connections when reconnecting sub assembly 54 to drill pipe 34. Spring 132 is preloaded and held in a chamber 138 by a retainer ring 140 positioned below a shoulder 142 on the inside surface of upper end 124 of stem 122 thereby yieldingly urging handling ring 64 upwardly. Spring 132 allows shoulder 128 of stem 122 to travel from its lower most position shown in FIG. 7 within a chamber 144 to its upper most position at a stop surface 146. Chamber 144 normally would include a fluid to dampen any rebound when sub assembly 54 is disconnected from drill string 28. The weight of drill string 28 suspended from elevator 68 causes spring 132 to become compressed and shoulder 128 of stem 122 to become seated on shoulder 96 of housing support 90. The load of drill string 28 now passes through elevator 68, upwardly through elevator links 66, through handling ring 64, through a shoulder 150 on a support ring 148, through a shear ring 136, through shoulder 130 on lower end 126 of stem 122, upwardly through stem 122 through shoulder 128 seated on shoulder 96 of housing support 90, through housing support 90 and into main links 60*a*. Stem 122 supports handling ring 64 from housing support 90 of housing beam 62 and provides an alternative load path bypassing sub assembly 54 and swivel bearing 52 when transferring loads suspended from elevator 68.

Figure 8:
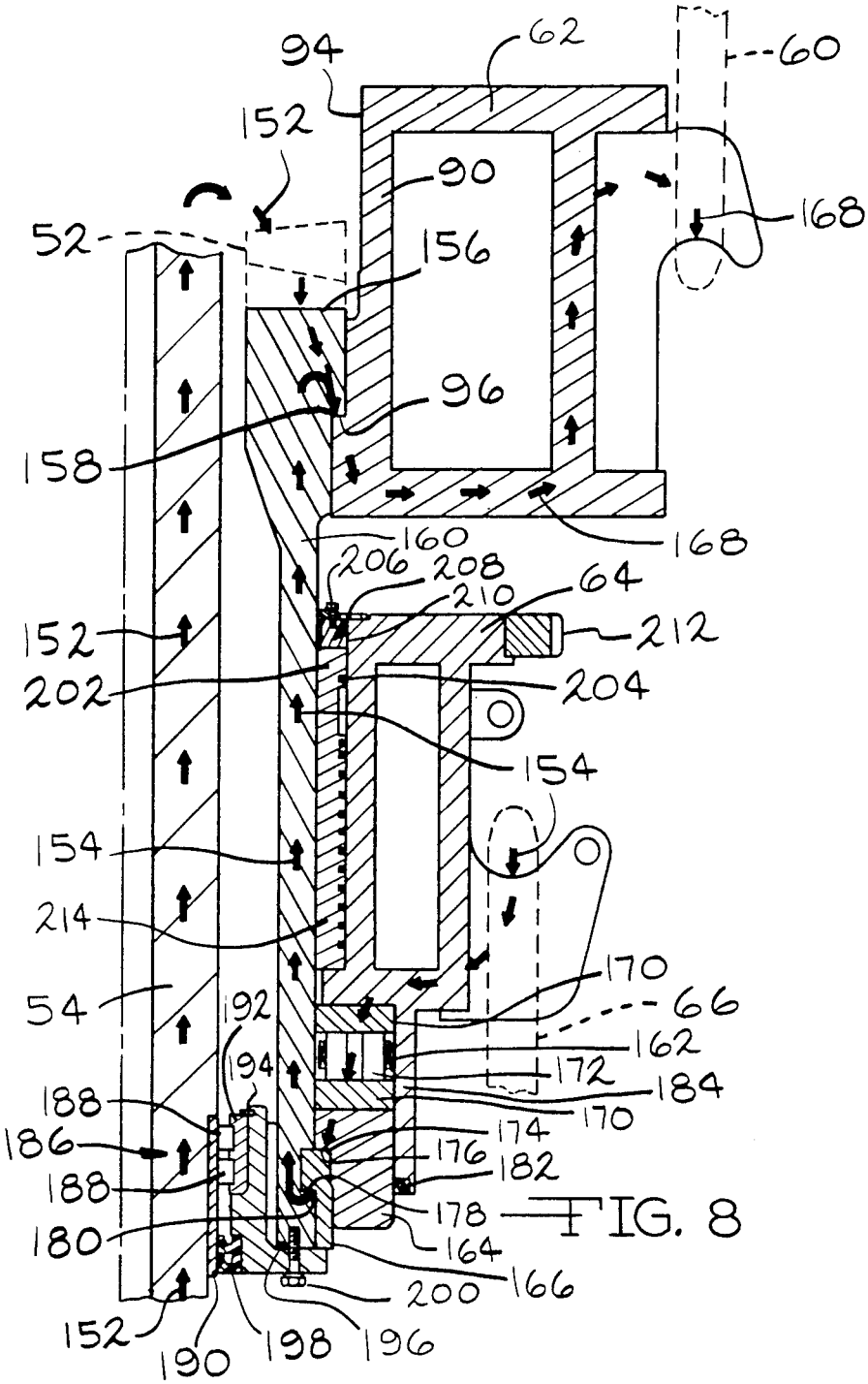
FIG. 8 is an elevation section view of another embodiment of the housing beam and handling ring.

FIG. 8 shows load paths 152 and 154 of another embodiment of my invention. Load path 152 illustrates when drill string 28 is connected to drill motor 46 by sub assembly 54. Load path 152 passes upwardly through the drive sleeve of sub assembly 54, through swivel bearing 52 into an upper surface 156 of a shoulder 158 of a stem 160 and then passes through shoulder 96 of housing support 90 of housing beam 62. When drill string 28 is disconnected from sub assembly 54 and supported by elevator links 66, the load is routed along load path 154 passing through handling ring 64, through a bearing 162, a bearing support ring 164, a shear ring 166 and into stem 160. The load then passes upwardly along path 154 in stem 160, through shoulder 158 seated on shoulder 96 of housing support 90. At this point, load paths 152 and 154 merge into a load path 168 passing outwardly into support links 60.

Unlike FIGS. 5 and 7, handling ring 64 of FIG. 8 is rotatably supported by stem 160 from housing support 90. Bearing 162 includes upper and lower bearing races 170 and thrust rollers 172. The inner surface of support ring 164 includes a shoulder 174 for seating on an upper surface 176 on shear ring 166. Shear ring 166 also includes a shoulder 178 for seating on a lower shoulder 180 on stem 160. Bearing 162 is sealed by a gasket 182 near the bottom of a flange 184 extending downwardly from handling ring 64. The lower end of stem 160 is held concentric with sub assembly 54 by a bearing 186 including rollers 188, an inner bearing race 190, an outer race 192, a retainer ring 194, and seals 196, 198. Bearing 186 is secured to the lower end of stem 160 by bolts 200. Accordingly, stem 160 supports rotatable handling ring 64 from housing support 90 providing an alternative load path for bypassing swivel bearing 52 when a load is suspended from elevator 68.

The embodiment of FIG. 8 also includes a means for maintaining fluid support between stem 160 and handling ring 64. The fluid support means includes an air conductor ring 202, an O-ring 204, a retainer assembly 206 including an air retaining ring 208 and a bearing 210, and a drive gear 212. Air conductor ring 202 includes passages 214 for permitting fluid flow providing "floating" support between handling ring 64 and stem 160.

As described above, my invention includes a handling system providing two distinct load paths when supporting a drill string. The handling system includes a handling ring, a housing beam and a stem for supporting the handling ring. During drilling, the drill string is connected through a sub assembly to a drill motor. The path of the load passes up the sub assembly, through a swivel bearing, and into the housing beam. During tripping or when running casing liner, the path of the load passes through the handling ring, through the stem, and into the housing beam bypassing the swivel bearing. Accordingly, the swivel bearing is isolated and does not experience heavy load when running casing liner or heavy cyclic loads during tripping.

It will be understood many modifications may be made to the components of the motor drive assembly or handling system. For example, the suspended weight of the power swivel can be counterbalanced using springs or hydraulic actuators. A handling ring may be rigidly connected to or rotatably supported by a housing beam. A stem for supporting the handling ring from the housing beam may be integral with the housing beam or rotatably supported by the housing beam. The various structural members within the housing beam as well as the handling ring need not be annular. The handling ring must be co-axially aligned with the through-bore of the housing beam with the structural members coaxially aligned and within the through-bore of the housing beam. Therefore, the limits of my invention should be determined from the appended claims.

I claim:

1. For use in a derrick, a power swivel for rotation of a drill string, comprising:

a motor drive assembly for rotating the drill string, a handling system for supporting the drill string, said motor drive assembly including a drill motor, a swivel bearing for supporting the load of the drill string during drilling, and a sub assembly for threadably connecting said drill motor to the drill string, said handling system including a swivel bearing housing beam for supporting said swivel bearing and a handling ring, said housing beam including means for supporting said handling ring and said drive assembly, whereby said swivel bearing is isolated by said support means from drill string loads during tripping and casing loads when lining a well.

2. The power swivel of claim 1 wherein said handling system includes an elevator for supporting a drill pipe and elevator links for suspending said elevator from said handling ring.

3. The power swivel of claim 1 wherein said handling ring is rotatably connected to said support means.

4. The power swivel of claim 1 wherein said handling system includes a traveling block, said housing beam suspended from said traveling block by support links.

5. The power swivel of claim 1 wherein said support means includes a housing support.

6. The power swivel of claim 5 wherein said load support means includes a stem, said handling ring suspended from said housing support by said stem.

7. The power swivel of claim 6 wherein said handling system includes an elevator for supporting a drill pipe and elevator links for suspending said elevator from said handling ring.

8. The power swivel of claim 6 wherein the inner surface of said housing support includes a shoulder for supporting said swivel bearing.

9. The power swivel of claim 8 wherein said housing beam includes a bearing member, the outer surface of said bearing member including a shoulder for transferring the load of said swivel bearing to said housing support.

10. The power swivel of claim 9 wherein said shoulder of said bearing member is seated on said shoulder of said housing support.

11. The power swivel of claim 8 wherein the outer surface of said stem includes a shoulder.

said shoulder of said stem seated on said shoulder of said housing support.

12. The power swivel of claim 9 wherein said handling system includes a swivel bearing ring disposed between said bearing member and said stem, the inner surface of said bearing ring including a shoulder for supporting said shoulder of said bearing member, the outer surface of said bearing ring including a shoulder for being supported by said shoulder of said housing support, said inner surface of said housing support including a second shoulder, the outer surface of said stem including a shoulder for being supported by said second shoulder of said housing support.

13. The power swivel of claim 12 including a spring disposed between said bearing ring and said stem thereby allowing said handling ring to shift vertically relative to said housing support.

14. The power swivel of claim 11 wherein said handling ring includes a bearing, the outer surface of said stem including a second shoulder for supporting said handling ring bearing, whereby said handling ring is rotatably supported by said housing beam.

15. The power swivel of claim 14 wherein said handling system includes a traveling block, support links for suspending said housing beam from said traveling block, each of said support links including a spring.

16. The power swivel of claim 14 including a means for maintaining fluid support between said handling ring and said stem.

17. The power swivel of claim 16 wherein said fluid support means includes an air conductor ring disposed between said stem and said handling ring.

18. The power swivel of claim 14 including a bearing disposed between said sub assembly and said stem.

19. For use in a derrick, a power swivel for rotation of a drill string, comprising:

a motor drive assembly rotating the drill string, a handling system for supporting the drill string, said motor drive assembly including a drill motor, a swivel bearing for supporting the load of the drill string during drilling, and a sub assembly for threadably connecting said drill motor to the drill string, said handling system including a swivel bearing housing beam for supporting said swivel bearing, a stem for supporting the load of the drill string during tripping, an elevator for supporting the drill string, a handling ring, elevator links for suspending said elevator from said handling ring, a traveling block and support links for suspending said housing beam from said traveling block, the outer surface of said stem including a shoulder, said housing beam including a housing support, the inner surface of said housing support including a shoulder for supporting said shoulder of said stem, whereby loads supported by said elevator pass through said stem to said housing support bypassing said swivel bearing.

20. For use in a derrick, a power swivel for rotation of a drill string, comprising:

a motor drive assembly for rotating the drill string, a handling system for supporting the drill string, said motor drive assembly including a drill motor, a swivel bearing for supporting the load of drill string during drilling, and a sub assembly for threadably connecting said drill motor to the drill string, said handling system including an annular swivel bearing housing beam and an annular handling ring, said housing beam including annular means for supporting said handling ring and said drive assembly, said support means being disposed within the bore of said housing beam, whereby said swivel bearing is isolated by said support means for drill string loads during tripping and casing loads when lining a well.

* * * * *